US011233337B2

(12) United States Patent
Ryoo et al.

(10) Patent No.: US 11,233,337 B2
(45) Date of Patent: Jan. 25, 2022

(54) ANTENNA APPARATUS

(71) Applicant: Samsung Electro-Mechanics Co., Ltd., Suwon-si (KR)

(72) Inventors: Jeong Ki Ryoo, Suwon-si (KR); Hong In Kim, Suwon-si (KR); Myeong Woo Han, Suwon-si (KR); Nam Ki Kim, Suwon-si (KR); Dae Ki Lim, Suwon-si (KR); Ju Hyoung Park, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 522 days.

(21) Appl. No.: 16/169,367

(22) Filed: Oct. 24, 2018

(65) Prior Publication Data

US 2019/0273325 A1 Sep. 5, 2019

(51) Int. Cl.
*H01Q 21/10* (2006.01)
*H01Q 21/06* (2006.01)
(Continued)

(52) U.S. Cl.
CPC ..... *H01Q 21/061* (2013.01); *H01Q 5/35* (2015.01); *H01Q 9/045* (2013.01);
(Continued)

(58) Field of Classification Search
CPC .... H01Q 9/0407; H01Q 9/045; H01Q 9/0478; H01Q 9/0442; H01Q 9/0435; H01Q 9/0428; H01Q 21/065; H01Q 21/067
See application file for complete search history.

(56) References Cited

U.S. PATENT DOCUMENTS 5,952,971 A * 9/1999 Strickland ..... H01Q 1/38 343/700 MS
6,239,750 B1 * 5/2001 Snygg ..... H01Q 1/246 343/700 MS
(Continued)

FOREIGN PATENT DOCUMENTS

CN 1451189 A 10/2003
CN 2593385 Y 12/2003
(Continued)

OTHER PUBLICATIONS

Korean Office Action dated Feb. 27, 2019 in the corresponding Korean Patent Application No. 10-2018-0072739 (4 pages in English and 4 pages in Korean).
(Continued)

*Primary Examiner* — Ab Salam Alkassim, Jr.
(74) *Attorney, Agent, or Firm* — NSIP Law

(57) ABSTRACT

An antenna apparatus includes patch antennas arranged in an N×1 array, first feed vias, second feed vias, third feed vias, and fourth feed vias connected to a point offset from a center of each of the patch antennas, in a first direction, second direction, third direction, and fourth direction, respectively a first RF signal of a first phase passes through the first feed vias and the second feed vias, a second RF signal of a second phase passes through the third feed vias and the fourth feed vias, and wherein a line between the point in the first direction and the point in the second direction is oblique to a direction of an array of the patch antennas, and a line between the point in the third direction and the point in the fourth direction is oblique to the direction of the array.

16 Claims, 8 Drawing Sheets

(51) Int. Cl.

| | |
|---|---|
| ***H01Q 21/00*** | (2006.01) |
| ***H01Q 9/04*** | (2006.01) |
| ***H01Q 5/35*** | (2015.01) |
| ***H01Q 9/16*** | (2006.01) |

(52) U.S. Cl.
CPC ..... *H01Q 9/0407* (2013.01); *H01Q 9/0414* (2013.01); *H01Q 9/16* (2013.01); *H01Q 21/0006* (2013.01); *H01Q 21/065* (2013.01); *H01Q 21/067* (2013.01); *H01Q 21/10* (2013.01)

(56) References Cited

U.S. PATENT DOCUMENTS

| | | | | |
|---|---|---|---|---|
| 6,768,454 | B2 | 7/2004 | Kingsley et al. | |
| 9,921,255 | B2 * | 3/2018 | Bowers | H01Q 21/24 |
| 10,141,640 | B2 * | 11/2018 | Howard | H01Q 1/523 |
| 10,153,557 | B2 * | 12/2018 | Sudo | H01Q 13/08 |
| 10,205,224 | B2 * | 2/2019 | Mow | H01Q 9/0421 |
| 10,340,607 | B2 * | 7/2019 | Sanderovich | H01Q 25/00 |
| 10,381,747 | B2 * | 8/2019 | Chien | H01Q 9/0414 |
| 10,629,999 | B2 * | 4/2020 | Howard | H01Q 21/065 |
| 10,770,794 | B2 * | 9/2020 | Bartone | H01Q 9/0428 |
| 2002/0014995 | A1 * | 2/2002 | Roberts | H01Q 9/0442 343/700 MS |
| 2003/0151548 | A1 * | 8/2003 | Kingsley | H01Q 3/24 342/368 |
| 2006/0007044 | A1 * | 1/2006 | Crouch | H01Q 9/0435 343/700 MS |
| 2008/0100530 | A1 * | 5/2008 | Manholm | H01Q 9/0428 343/893 |
| 2009/0066601 | A1 * | 3/2009 | Eom | H01Q 9/285 343/798 |
| 2009/0128413 | A1 * | 5/2009 | Crouch | H01Q 3/26 343/700 MS |
| 2009/0174613 | A1 * | 7/2009 | Liu | H01Q 25/005 343/702 |
| 2012/0032869 | A1 * | 2/2012 | Hawkins | H01Q 9/045 343/857 |
| 2013/0076585 | A1 * | 3/2013 | Kim | H01Q 9/0435 343/787 |
| 2013/0106671 | A1 * | 5/2013 | Eom | H01Q 21/29 343/853 |
| 2013/0201065 | A1 * | 8/2013 | Parsche | H01Q 7/00 343/743 |
| 2014/0198014 | A1 * | 7/2014 | Fasenfest | H01Q 9/045 343/906 |
| 2014/0266902 | A1 * | 9/2014 | Kamgaing | H01Q 15/08 342/374 |
| 2014/0266963 | A1 * | 9/2014 | Fasenfest | H01Q 9/045 343/857 |
| 2015/0148098 | A1 * | 5/2015 | Grau Besoli | H01Q 1/007 455/553.1 |
| 2015/0207235 | A1 * | 7/2015 | Lee | H01Q 21/24 343/767 |
| 2016/0248169 | A1 * | 8/2016 | Mohammadian | H01Q 21/065 |
| 2016/0276734 | A1 | 9/2016 | Jin et al. | |
| 2017/0012359 | A1 * | 1/2017 | Jung | H01Q 3/30 |
| 2017/0062908 | A1 * | 3/2017 | Sanderovich | H01Q 1/246 |
| 2017/0125919 | A1 * | 5/2017 | Chien | H01Q 9/045 |
| 2017/0222333 | A1 * | 8/2017 | Sudo | H01Q 1/38 |
| 2017/0229769 | A1 * | 8/2017 | Yokoyama | H01L 21/78 |
| 2017/0310017 | A1 * | 10/2017 | Howard | H01Q 21/0006 |
| 2017/0365935 | A1 | 12/2017 | Kashino et al. | |
| 2019/0288397 | A1 * | 9/2019 | Gao | H01Q 9/0421 |
| 2019/0363453 | A1 * | 11/2019 | Yu | H01Q 21/062 |
| 2020/0076078 | A1 * | 3/2020 | Tehran | H01Q 1/523 |
| 2020/0212596 | A1 * | 7/2020 | Chen | H01Q 9/0435 |
| 2020/0412022 | A1 * | 12/2020 | Yun | H01Q 9/0457 |
| 2021/0005956 | A1 * | 1/2021 | Choudhury | H01Q 9/0407 |

FOREIGN PATENT DOCUMENTS

| | | | |
|---|---|---|---|
| CN | 101355195 | A | 1/2009 |
| CN | 201188461 | Y | 1/2009 |
| CN | 104681971 | A | 6/2015 |
| JP | 2017-225023 | A | 12/2017 |
| KR | 2003-0039326 | A | 5/2003 |
| KR | 10-0922001 | B1 | 10/2009 |
| KR | 10-1115157 | B1 | 2/2012 |
| KR | 10-2016-0112154 | A | 9/2016 |
| KR | 10-2017-0048586 | A | 5/2017 |
| KR | 10-1833037 | B1 | 2/2018 |
| WO | WO 2012/021439 | A2 | 2/2012 |

OTHER PUBLICATIONS

Chinese Office Action dated Jun. 11, 2020 in counterpart Chinese Patent Application No. 201910071118.6 (11 pages in English and 9 pages in Chinese).

Chinese Office Action dated Feb. 9, 2021 in counterpart Chinese Patent Application No. 201910071118.6 (10 pages in English and 8 pages in Chinese).

Korean Office Action daetd Jul. 31, 2021, in Counterpart Korean Patent Application No. 10-2019-0103060 (4 pages in English and 4 pages in Korean).

* cited by examiner

ANTENNA APPARATUS

CROSS-REFERENCE TO RELATED APPLICATIONS

This application claims the benefit under 35 U.S.C. § 119(a) of Korean Patent Application No. 10-2018-0025269 filed on Mar. 2, 2018, and Korean Patent Application No. 10-2018-0072739 filed on Jun. 25, 2018 in the Korean Intellectual Property Office, the entire disclosures of which are incorporated herein by reference for all purposes.

BACKGROUND

1. Field

The following description relates to an antenna apparatus.

2. Description of Related Art

Data traffic of mobile communications is rapidly increasing, and technological development is underway to support the transmission of the increased data in real time in wireless networks. For example, the contents of internet of things (IoT) based data, augmented reality (AR), virtual reality (VR), live VR/AR combined with SNS, autonomous navigation, applications such as Sync View (real-time video transmissions of users using ultra-small cameras) require communications (e.g., 5G communications, mmWave communications, etc.) supporting the transmission and reception of large amounts of data.

Recently, research is being conducted in millimeter wave (mmWave) communications, including $5^{th}$ generation (5G) communications, and the commercialization/standardization of an antenna apparatus smoothly realizing such communications.

Since RF signals in high frequency bands (e.g., 24 GHz, 28 GHz, 36 GHz, 39 GHz, 60 GHz, etc.) are easily absorbed and lost in the course of the transmission thereof, the quality of communications may be dramatically reduced. Therefore, antennas for communications in high frequency bands may require different approaches from those of conventional antenna technology, and a separate approach may require further special technologies, such as separate power amplifiers for securing antenna gain, integrating an antenna and RFIC, and securing effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to an aspect, there is disclosed an antenna apparatus including patch antennas arranged in an N×1 array, first feed vias connected to a point offset, in a first direction, from a center of each of the patch antennas, and through which an RF signal of a first phase passes, second feed vias connected to a point offset, in a second direction, from a center of each of the patch antennas, and through which the RF signal of the first phase passes, third feed vias connected to a point offset, in a third direction, from a center of each of the patch antennas, and through which an RF signal of a second phase, different from the first phase, passes, and fourth feed vias connected to a point offset, in a fourth direction, from a center of each of the patch antennas, and through which the RF signal of the second phase passes, wherein a line extending between the point in the first direction and the point in the second direction is oblique to a direction of an array of the patch antennas, and a line extending between the point in the third direction and the point in the fourth direction is oblique to the direction of the array of the patch antennas.

A transmitted RF signal of the patch antennas may be transferred from the first to fourth feed vias, and a received RF signal of the patch antennas is transferred to the first to fourth feed vias.

The second phase may be different from the first phase by 180 degrees.

Each of the patch antennas may be quadrangular, and the first, second, third, and fourth directions may be directions towards different sides of a quadrangle from the center of the quadrangle.

At least one of the patch antennas may include first slots with the point of the first feed vias being located between the first slots, second slots with the point of the second feed vias being located between the second slots, third slots with the point of the third feed vias being located between the third slots, and fourth slots with the point of the fourth feed vias being located between the fourth slots.

The antenna may include an upper coupling patches spaced apart from the patch antennas and being arranged in another N×1 array.

The antenna may include wiring vias with an end being electrically connected to the IC, first branch patterns with an end being electrically connected to the wiring vias, respectively, and being configured to branch the RF signal of the first phase to be transferred to the first and second feed vias, and second branch patterns with an end being electrically connected to the wiring vias, respectively, and being configured to branch the RF signals of the second phase to be transferred to the third and fourth feed vias.

Each of the second branch patterns may have an electrical length different from that of each of the first branch patterns.

The antenna may include feed lines with an end being electrically connected to the first, second, third, and fourth feed vias, respectively, wiring vias with an end being electrically connected to the f feed lines, respectively, and an IC electrically connected to another end of the wiring vias.

The antenna may include second wiring vias with an end being electrically connected to the IC, second feed lines with an end being electrically connected to the second wiring vias, respectively, and end-fire antennas electrically connected to one or two of the second feed lines, respectively.

The antenna may include ground layers disposed above and below a position of the feed lines, and wherein the feed lines and second feed lines may be disposed on a same level.

A number of the feed lines may be 4N, a number of the second feed lines may be M, wherein M may be greater than N, and less than 2N. N may be a multiple of 3, a number of the end-fire antennas may be N, M may be a multiple of four.

The end-fire antennas may be arranged in parallel with the patch antennas in another N×1 array, an end-fire antenna electrically connected to two of the second feed lines among the end-fire antennas may be more closely centered than an end-fire antenna electrically connected to only one of the second feed lines.

The antenna may include a ground layer disposed in a position above or below a position of the feed lines, and wherein an end-fire antenna, electrically connected to only one of the second feed lines among the end-fire antennas, may be electrically connected to the ground layer.

A line extending between the point in the first direction and the point in the third direction may be parallel to a direction of an array of the patch antennas, and a line extending between the point in the second direction and the point in the fourth direction may be perpendicular to the direction of the array of the patch antennas.

The first, second, third, and fourth vias may be positioned substantially adjacent to the edge of the quadrangle.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
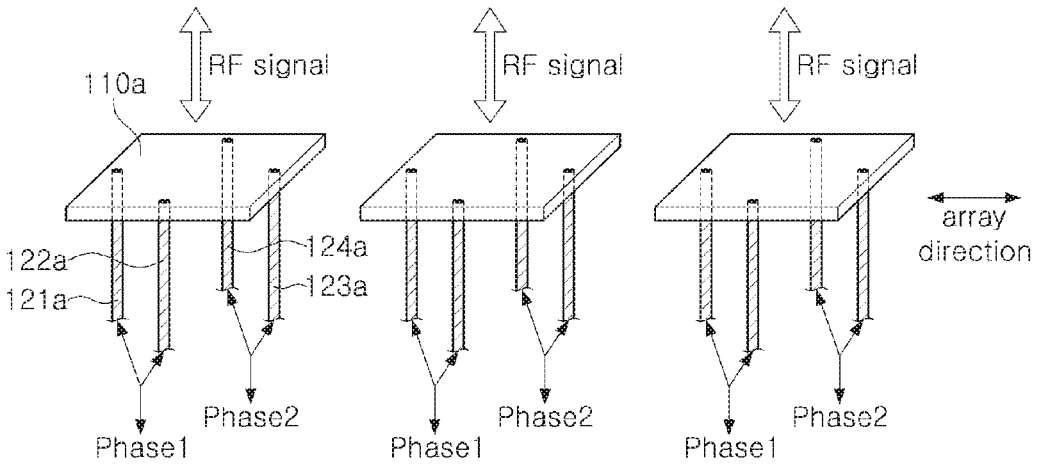
FIG. 1 is a diagram illustrating an example of an antenna apparatus.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

The terminology used herein is for describing various examples only, and is not to be used to limit the disclosure. As used herein, the term "and/or" includes any one and any combination of any two or more of the associated listed items. The articles "a," "an," and "the" are intended to include the plural forms as well, unless the context clearly indicates otherwise.

The use of the term "may" with respect to an example or embodiment, e.g., as to what an example or embodiment may include or implement, means that at least one example or embodiment exists in which such a feature is included or implemented while all examples and embodiments are not limited thereto.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

FIG. 1 is a diagram illustrating an example of an antenna apparatus.

Referring to FIG. 1, an antenna apparatus may include a plurality of patch antennas 110*a*, a plurality of first feed vias 121*a*, a plurality of second feed vias 122*a*, a plurality of third feed vias 123*a*, and a plurality of fourth feed vias 124*a*.

The plurality of patch antennas 110*a* may be arranged in an N×1 structure. In an example, N may be a natural number of 2 or more. For example, the plurality of patch antennas 110*a* may have a structure arranged in one row in an array direction.

The plurality of first feed vias 121*a* may be configured to be connected to a point shifted or offset, in a first direction, from a center of each of the plurality of patch antennas 110*a*, and to pass a radio frequency (RF) signal of a first phase, Phase 1.

The plurality of second feed vias 122*a* may be configured to be connected to a point shifted or offset, in a second direction, from a center of each of the plurality of patch antennas 110*a*, and to pass an RF signal of a first phase, Phase 1.

The plurality of third feed vias 123*a* may be configured to be connected to a point shifted or offset, in a third direction, from a center of each of the plurality of patch antennas 110*a*, and to pass an RF signal of a second phase, Phase 2, different from a first phase, Phase 1.

The plurality of fourth feed vias 124*a* may be may be configured to be connected to a point shifted or offset, in a fourth direction, from a center of each of the plurality of patch antennas 110*a*, and to pass an RF signal of a second phase, Phase 2.

In an example, the first direction, the second direction, third direction, and the fourth direction are different directions from a center of each of the plurality of patch antennas, In an example, the RF signal of the first phase, Phase 1, is transferred from all of the plurality of first and second feed vias 121*a* and 122*a* to the plurality of patch antennas 110*a* at the time of transmission. The RF signal of the second phase, Phase 2, may be transferred from all of the plurality of third and fourth feed vias 123*a* and 124*a* to the plurality of patch antennas 110*a* at the time of transmission.

Similarly, the RF signal of the first phase, Phase 1, may be transferred to all of the plurality of first and second feed vias 121*a* and 122*a* from the plurality of patch antennas 110*a*. The RF signal of the second phase, Phase 2, may be transferred to all of the plurality of third and fourth feed vias 123*a* and 124*a* from the plurality of patch antennas 110*a*.

In an example, the first phase, Phase 1, and the second phase, Phase 2, may differ from each other by about 180 degrees. For example, the RF signal of the first phase, Phase 1, may be passed through the plurality of patch antennas 110*a* in the form of horizontal polarized wave, and the RF signal of the second phase, Phase 2, may be passed through the plurality of patch antennas 110*a* in the form of vertical polarized wave.

Therefore, the RF signal of the first phase, Phase 1, and the RF signal of the second phase, Phase 2, do not cause destructive interference with respect to each other. The antenna apparatus may transmit and receive the RF signal of the first phase, Phase 1, and the RF signal of the second phase, Phase 2, together, and thus may have a high transmission/reception ratio.

The plurality of first, second, third, and fourth feed vias 121*a*, 122*a*, 123*a*, and 124*a* may be electrically connected to the corresponding patch antenna 110*a*, respectively, among the plurality of patch antennas 110*a*. Since the antenna apparatus has a high transmission/reception ratio, the IC may transmit and receive a large amount of data remotely.

When the RF signal of the first phase, Phase 1, and the RF signal of the second phase, Phase 2, are passed through in the plurality of patch antennas 110*a*, a surface current may flow from connection positions of the plurality of first, second, third, and fourth feed vias 121*a*, 122*a*, 123*a*, and 124*a* in the plurality of patch antennas 110*a*.

In an example, the surface current flows opposite to a direction from the center of the patch antennas 110*a* where the respective feed vias are shifted. For example, a first surface current due to the RF signal transfer of the plurality of first feed vias 121*a* may flow in a direction opposite to the first direction. A second surface current due to the RF signal transfer of the plurality of second feed vias 122*a* may flow in a direction opposite to the second direction. A third surface current due to the RF signal transfer of the plurality of third feed vias 123*a* may flow in a direction opposite to the third direction. A fourth surface current due to the RF signal transfer of the plurality of fourth feed via 124*a* may flow in a direction opposite to the fourth direction.

In this case, a surface current flowing in one of the plurality of patch antennas 110*a* may affect an adjacent patch antenna electromagnetically. In an example, the antenna apparatus has a structure that reduces the electromagnetic influence of the surface current flowing in the plurality of patch antennas 110*a* to the adjacent patch antenna.

In an example, the first surface current due to the RF signal transfer of the plurality of first feed vias 121*a* and the second surface current due to the RF signal transfer of the plurality of second feed vias 122*a* may overlap each other. The third surface current due to the RF signal transfer of the third feed via 123*a* and the fourth surface current due to the RF signal transfer of the plurality of the fourth feed via 124*a* may overlap each other.

In an example, the current due to the overlap of the first surface current and the second surface current may flow in a direction opposite to a direction between the first direction and the second direction, and the current due to the overlap of the third surface current and the fourth surface current may flow in a direction opposite to a direction between the third direction and the fourth direction. For example, when the plurality of patch antennas 110*a* are quadrangular, the first, second, third, and fourth directions may be directions facing from a center of a quadrangle to the respective sides.

For example, a direction between the first direction and the second direction may be oblique, relative to an array direction of the plurality of patch antennas 110*a*, and a direction between the third direction and the fourth direction may be oblique, relative to an array direction of the plurality of patch antennas 110*a*.

Therefore, the antenna apparatus may have a relatively high transmission/reception ratio of RF signals of two or more phases, and may relatively reduce electromagnetic interference by using four or more feed vias per one patch antenna. The plurality of patch antennas may be arranged closer to each other, as the electromagnetic interference between the plurality of patch antennas is smaller. Therefore, the antenna apparatus may have a reduced size while ensuring an improved antenna performance (e.g., transmission/reception ratio).

Figure 2:
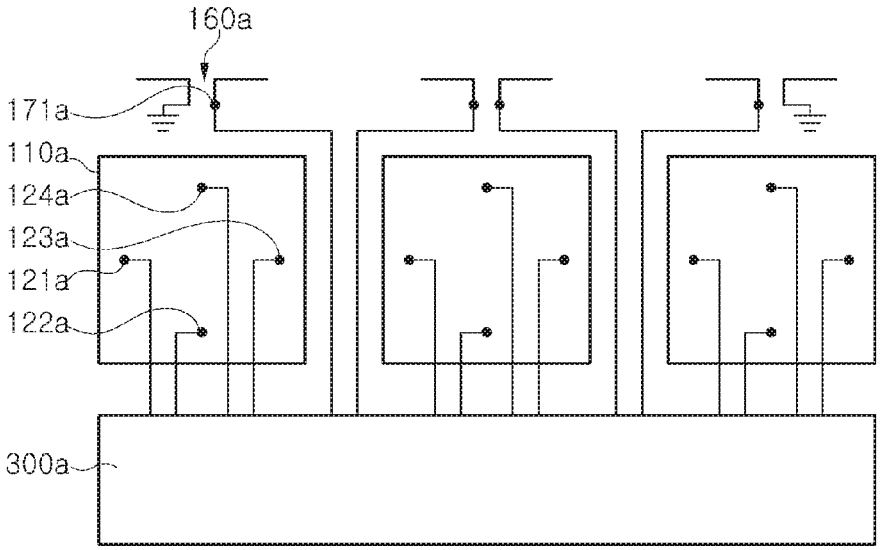
FIG. 2 is a diagram illustrating an example of connection points of feed vias of an antenna apparatus.

FIG. 2 is a diagram illustrating an example of connection points of feed vias of an antenna apparatus.

Referring to FIG. 2, an antenna apparatus may include at least a portion of a plurality of patch antennas 110*a*, a plurality of first feed vias 121*a*, a plurality of second feed vias 122*a*, a plurality of third feed vias 123*a*, a plurality of fourth feed vias 124*a*, a plurality of end-fire antennas 160*a*, and a plurality of second feed lines 171*a*.

The plurality of patch antennas 110*a* may be configured to remotely receive RF signals, and transfer the RF signals to the plurality of first, second, third, and fourth feed vias 121*a*, 122*a*, 123*a*, and 124*a*, or to receive RF signals from the plurality of first, second, third, and fourth feed vias 121*a*, 122*a*, 123*a*, and 124*a*, and remotely transmit the RF signals. For example, each of the plurality of patch antennas 110*a* may have a structure of a patch antenna having both surfaces of a circular or polygonal shape. Both surfaces of each of the plurality of patch antennas 110*a* may function as a boundary through which an RF signal passes between a conductor and a non-conductor. The plurality of patch antennas 110*a* may have an intrinsic frequency band (e.g., 28 GHz) based on intrinsic factors, such as, for example, shape, size, height, and dielectric constant of the insulating layer.

In an example, the plurality of first, second, third, and fourth feed vias 121*a*, 122*a*, 123*a*, and 124*a* may transfer an RF signal received from the plurality of patch antennas 110*a* to an IC 300*a*, and may transfer an RF signal received from the IC 300*a* to the plurality of patch antennas 110*a*.

In an example, the plurality of first, second, third, and fourth feed vias 121*a*, 122*a*, 123*a*, and 124*a* may be positioned adjacent to edges of the plurality of patch antennas 110*a*, respectively. For example, the first feed via 121*a* may be located at a nine (9) o'clock side edge, the second feed via 122*a* may be located at a six (6) o'clock side edge, the third feed via 123*a* may be located at a three (3) o'clock side edge, and the fourth feed via 124*a* may be located at a twelve (12) o'clock side edge. Therefore, the degree of isolation between the first phase RF signal and the second phase RF signal may be further improved.

In an example, the plurality of first feed vias 121*a* and the plurality of third feed vias 123*a* may be symmetrical with respect to the center of the plurality of patch antennas 110*a*, and the plurality of second feed vias 122*a* and the plurality of fourth feed vias 124*a* may be symmetrical with respect to the center of the plurality of patch antennas 110*a*. Therefore, the degree of isolation between the first phase RF signal and the second phase RF signal may be further improved.

In an example, a direction of a line connecting the plurality of first feed vias 121*a* and the plurality of third feed vias 123*a* may be the same as the array direction of the plurality of patch antennas 110*a*, and a direction of a line connecting the plurality of second feed vias 122*a* and the plurality of fourth feed vias 124*a* may be perpendicular to the array direction of the plurality of patch antennas 110*a*. As a result, electromagnetic influence exerted on an adjacent patch antenna by the surface current flowing in the plurality of patch antennas 110*a* may be further reduced.

In an example, the plurality of end-fire antennas 160*a* may be disposed to be spaced apart from the plurality of patch antennas 110*a* in a direction perpendicular to the array direction of the plurality of patch antennas 110*a*. The plurality of end-fire antennas 160*a* may transmit and receive RF signals in a direction perpendicular to a direction of transmitting and receiving RF signals of the plurality of patch antennas 110*a*. Therefore, the antenna apparatus may transmit and receive RF signals omnidirectionally.

For example, each of the plurality of end-fire antennas 160*a* may be implemented by a dipole antenna, a monopole antenna, or a folded dipole antenna, but is not limited thereto.

In an example, a portion of the plurality of end-fire antennas 160*a* may have two second feed lines 171*a*, and the rest of the plurality of end-fire antennas 160*a* may have one second feed line 171*a*.

Therefore, the total number of the first, second, third, and fourth feed vias 121*a*, 122*a*, 123*a*, and 124*a*, and the plurality of second feed lines 171*a* may be relatively reduced, thus, helping to reduce a size of the antenna apparatus.

For example, the total number (i.e., 16) of feed paths of an comparative antenna apparatus in which the number of the plurality of patch antennas 110*a* is four, each of the plurality of patch antennas 110*a* does not include the third and fourth feed vias 123*a* and 124*a*, and the number of the plurality of end-fire antennas 160*a* is four, and each of the plurality of end-fire antennas 160*a* has two second feed lines 171*a*, may be identical to the total number (i.e., 16) of feed paths in the case of the antenna apparatus disclosed above where the number of the patch antennas 110*a* is three, the number of the plurality of end-fire antennas 160*a* is three, and the number of the second feed lines 171*a* is four.

The antenna apparatus may have a more improved gain than other comparative example. Therefore, the antenna apparatus may have improved antenna performance without increasing the total number of feed paths.

When generalized, the number of the plurality of feed vias may be 4N, and the number of the plurality of second feed lines may be M. In this case, M may be greater than N, but less than 2N. Therefore, the antenna apparatus may have improved antenna performance without increasing the total number of feed paths.

In general, N may be a multiple of three, the number of the plurality of end-fire antennas 160*a* may be N, and M may be a multiple of four. Therefore, the antenna apparatus may have improved antenna performance without increasing the total number of feed paths.

Meanwhile, the plurality of end-fire antennas 160*a* may be arranged in parallel with the plurality of patch antennas 110*a* in the N×1 structure. An end-fire antenna electrically connected to two of the plurality of the second feed lines 171*a* among the plurality of end-fire antennas 160*a* may be distributed to be more closely centered than an end-fire antenna electrically connected to only one of the plurality of second feed lines 171*a*. Therefore, the plurality of end-fire antennas 160*a* may suppress the deterioration of antenna performance while reducing the number of feed paths.

The IC 300*a* may generate the RF signal of the first phase and the RF signal of the second phase through a phase control, respectively. In an example, the antenna apparatus may implement the RF signal of the first phase and the RF signal of the second phase using a plurality of first, second, third, and fourth feed vias 121*a*, 122*a*, 123*a*, and 124*a* having different electrical lengths, instead of the phase control of the IC 300*a*.

Figure 3A:
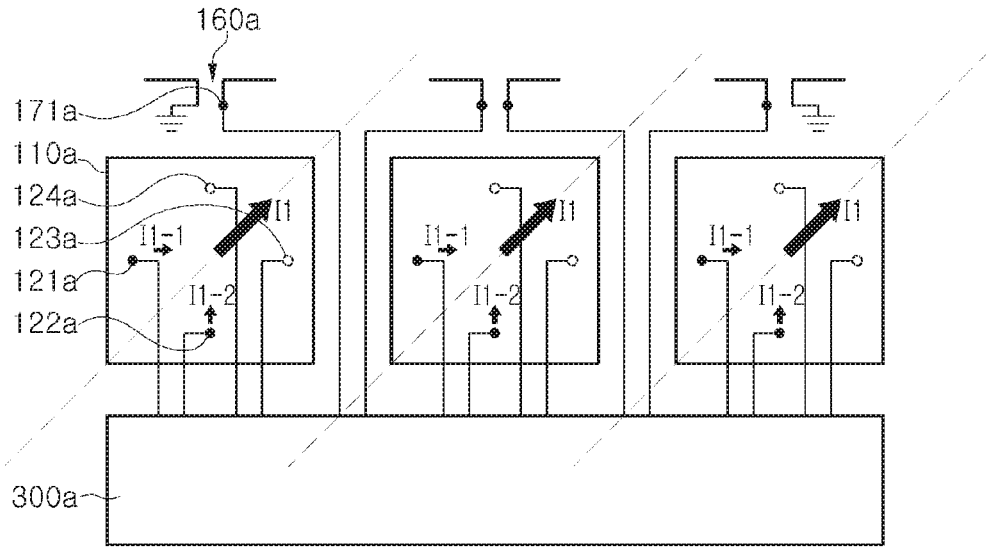
FIG. 3A is a diagram illustrating an example of transmission and reception of RF signals of a first phase of an antenna apparatus.

FIG. 3A is a diagram illustrating an example of transmission and reception of RF signals of a first phase of an antenna apparatus.

Referring to FIG. 3A, an antenna apparatus may form a first surface current 11-1 flowing in a three (3) o'clock direction from the plurality of first feed vias 121*a*, and a second surface current 11-2 flowing in a twelve (12) o'clock direction from the plurality of second feed vias 122*a*, when transmitting and receiving an RF signal of a first phase.

A first overlapped surface current 11 may be provided by an overlap of the first surface current I1-1 and the second surface current I1-2. The first overlapped surface current I1 may be diagonal to the array direction of the plurality of patch antennas 110*a*.

Figure 3B:
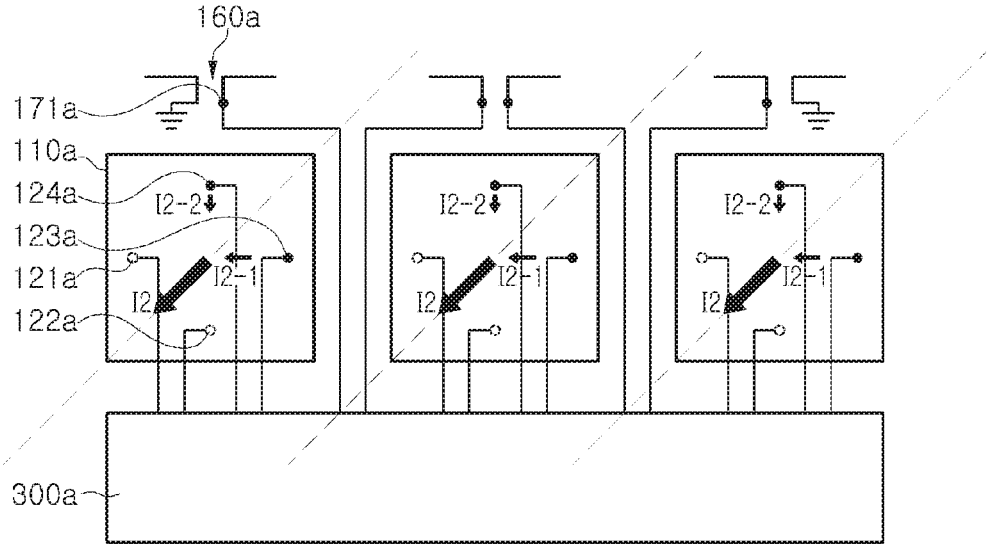
FIG. 3B is a diagram illustrating an example of transmission and reception of RF signals of a second phase of the antenna apparatus.

FIG. 3B is a diagram illustrating an example of transmission and reception of RF signals of a second phase of the antenna apparatus.

Referring to FIG. 3B, the antenna apparatus may form a third surface current I2-1 flowing in a nine (9) o'clock direction from the plurality of third feed vias 123*a*, and a fourth surface current I2-2 flowing in a six (6) o'clock direction from the plurality of fourth feed vias 124*a*, when transmitting and receiving an RF signal of a second phase.

A second overlapped surface current I2 may be provided by an overlap of the third surface current I2-1 and the fourth surface current I2-2. The second overlapped surface current I2 may be diagonal to the array direction of the plurality of patch antennas 110*a*.

Figure 4A:
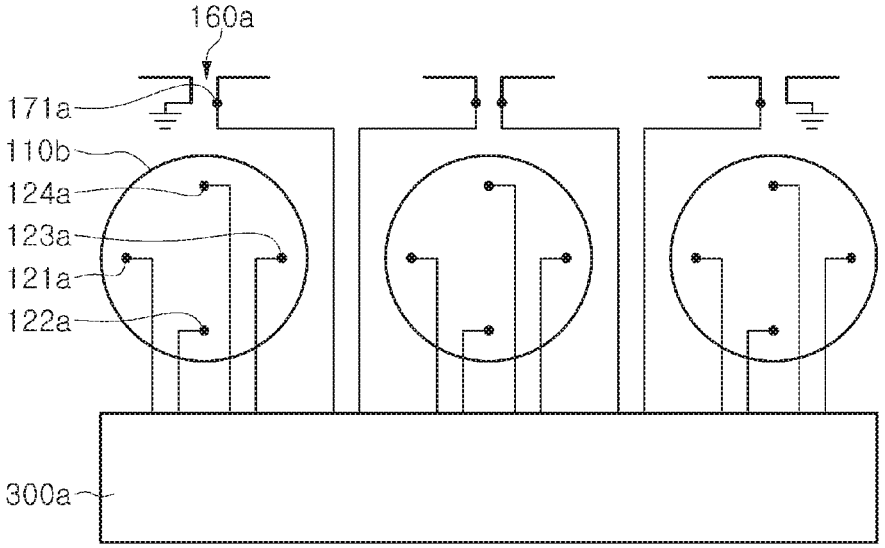
FIG. 4A is a diagram illustrating an example of a patch antenna of an antenna apparatus.

FIG. 4A is a diagram illustrating an example of a patch antenna of an antenna apparatus.

Referring to FIG. 4A, each of the plurality of patch antennas 110*b* included in an antenna apparatus that is circular.

Figure 4B:
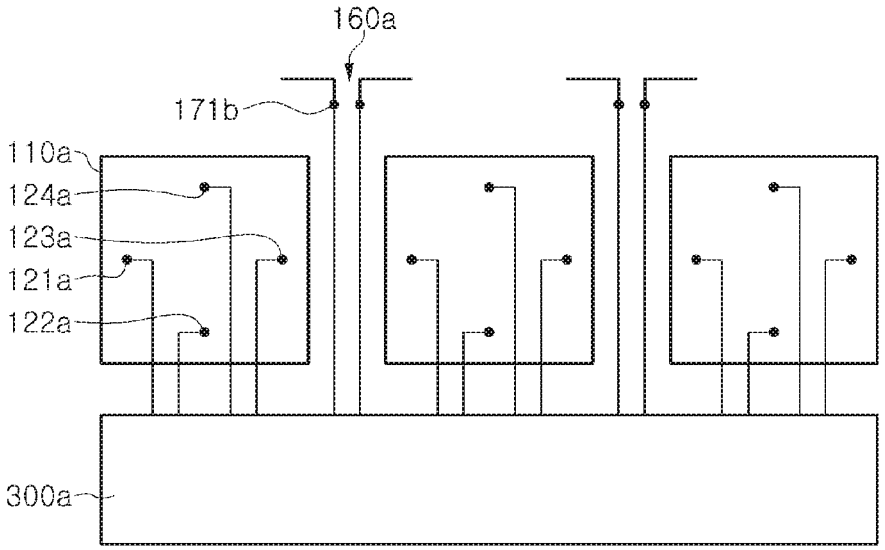
FIG. 4B is a diagram illustrating an example of a modification of an end-fire antenna of an antenna apparatus.

FIG. 4B is a diagram illustrating an example of a modification of an end-fire antenna of an antenna apparatus.

Referring to FIG. 4B, an antenna apparatus may include a plurality of end-fire antennas 160*a* spaced at a distance from a space between the plurality of patch antennas 110*a* in a twelve (12) o'clock direction, and each of the plurality of end-fire antennas 160*a* may have a plurality of second feed lines 171*b*. In this case, the total number (i.e., 16) of the feed paths of the antenna apparatus illustrated in FIG. 2 and the total number (i.e., 16) of the feed paths of the antenna apparatus illustrated in FIG. 4B may be the same as each other.

Figure 4C:
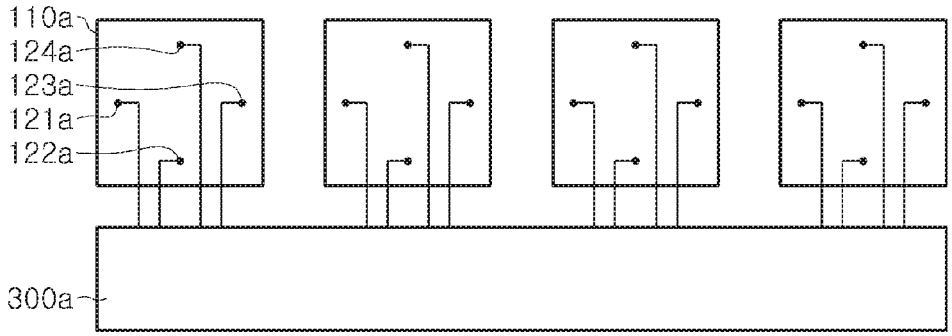
FIG. 4C is a diagram illustrating an example of a structure in which an end-fire antenna is omitted from an antenna apparatus.

FIG. 4C is a diagram illustrating an example of a structure in which an end-fire antenna is omitted from an antenna apparatus.

Referring to FIG. 4C, an antenna apparatus may increase the number of a plurality of patch antennas 110*a* without including an end-fire antenna. In this case, the total number (i.e., 16) of the feed paths of the antenna apparatus illustrated in FIG. 2 and the total number (i.e., 16) of the feed paths of the antenna apparatus illustrated in FIG. 4C may be the same as each other.

Figure 4D:
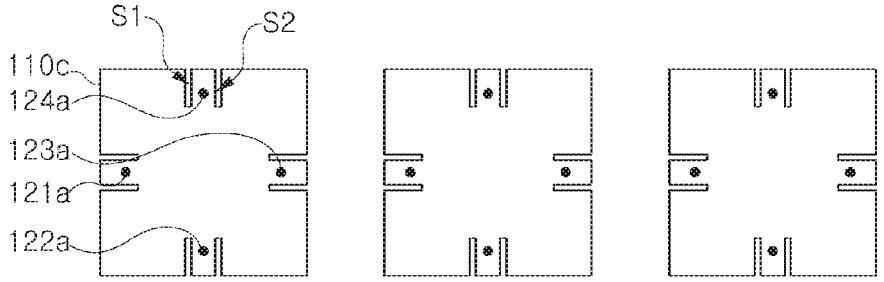
FIG. 4D is a diagram illustrating an example of a slot provided in a patch antenna in an antenna apparatus.

FIG. 4D is a diagram illustrating an example of a slot provided in a patch antenna in an antenna apparatus.

Referring to FIG. 4D, a plurality of patch antennas 110*c* may include first, second, third, and fourth slots S1 and S2, provided such that connection points of each of a plurality of first, second, third, and fourth feed vias 121*a*, 122*a*, 123*a*, and 124*a* are located in between their respective slots.

Therefore, the plurality of first, second, third, and fourth feed vias 121*a*, 122*a*, 123*a*, and 124*a* may have capacitances according to the plurality of first, second, third, and fourth slots S1 and S2. The capacitances may form a matching circuit together with the inductances of the first, second, third, and fourth feed vias 121*a*, 122*a*, 123*a*, and 124*a*. The larger the capacitance, the smaller the inductance. Therefore, the first, second, third, and fourth slots S1 and S2 may relatively reduce the length of the feed vias.

The plurality of first, second, third, and fourth slots S1 and S2 may further concentrate the directions of the first, second, third, and fourth surface currents, respectively. Therefore, the plurality of patch antennas 110*c* may further relatively reduce the electromagnetic interference to the adjacent patch antennas.

Figure 5A:
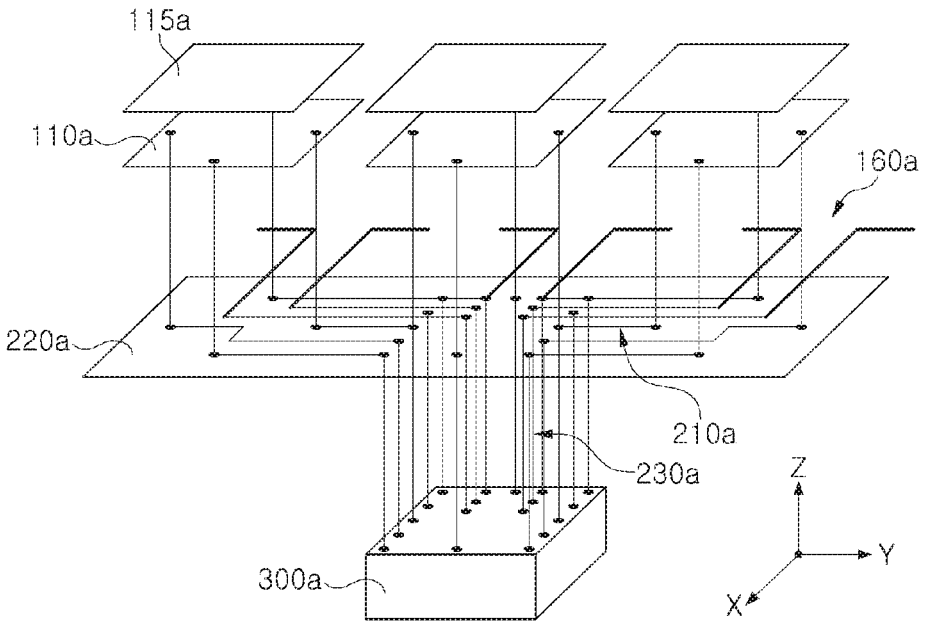
FIG. 5A is a diagram illustrating an example of an antenna apparatus.

FIG. 5A is a diagram illustrating an example of an antenna apparatus.

Referring to FIG. 5A, an antenna apparatus may include a plurality of upper coupling patches 115*a*, spaced apart from a plurality of patch antennas 110*a* in a Z direction and arranged in an N×1 structure. The plurality of upper coupling patches 115*a* may be electromagnetically coupled to the plurality of patch antennas 110*a* to improve gain or bandwidth of the plurality of patch antennas 110*a*.

In addition, an antenna apparatus may further include a wiring layer 220*a* including a plurality of feed lines 210*a*. The plurality of feed lines 210*a* may electrically connect a plurality of patch antennas 110*a* or a plurality of end-fire antennas 160*a* to an IC 300*a*, respectively. In an example, a plurality of wiring vias 230*a* may be arranged to electrically connect the plurality of feed lines 210*a* and the IC 300*a*.

Figure 5B:
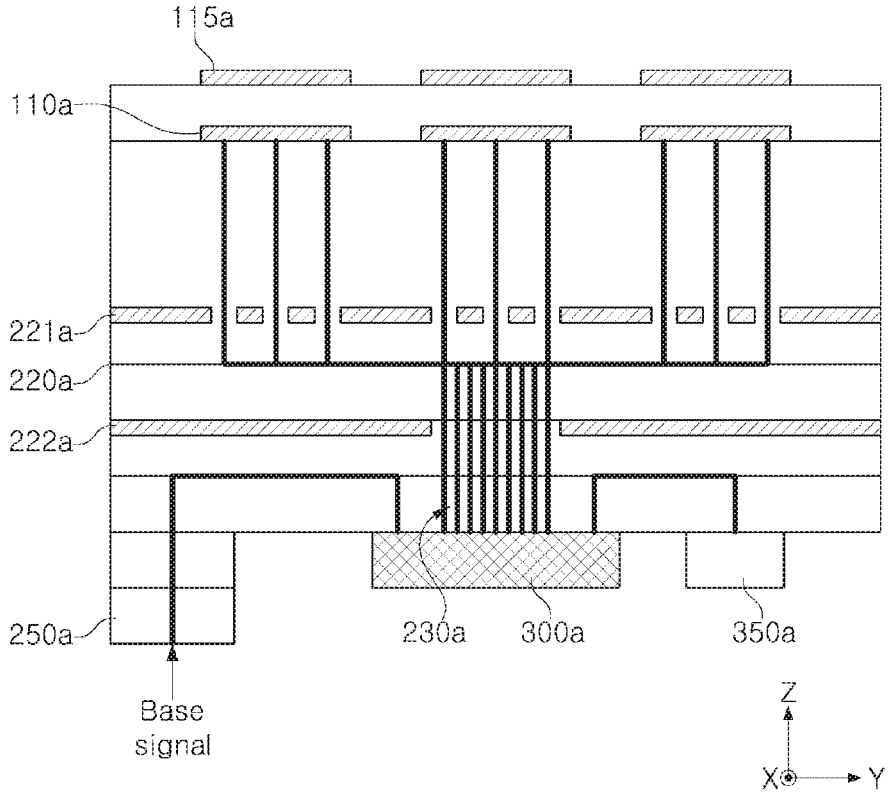
FIG. 5B is a diagram illustrating an example of an antenna apparatus.

FIG. 5B is a diagram illustrating an example of an antenna apparatus.

Referring to FIG. 5B, an antenna apparatus may include a ground layer 221*a* disposed below a plurality of patch antennas 110*a* and having through-holes through which a plurality of feed vias pass. The ground layer 221*a* may act as a reflector for the plurality of patch antennas 110*a*.

The wiring layer 220*a* may be disposed in a position lower than a position of the ground layer 221*a*. Therefore, the ground layer 221*a* may be an electromagnetic shield between the plurality of patch antennas 110*a* and the wiring layer 220*a*.

The second ground layer 222*a* may be disposed in a position lower than a position of the wiring layer 220*a*, and may have through-holes through which a plurality of wiring vias 230*a* pass. The second ground layer 222*a* may be an electromagnetic shield between the wiring layer 220*a* and the IC 300*a*.

The IC 300*a* may be disposed in a position lower than a position of the second ground layer 222*a*, and may be electrically connected to the wiring via 230*a*.

A passive component 350*a* and a sub-substrate 250*a* may be disposed in a position lower than a position of the second ground layer 222*a*, and may be electrically connected to the IC 300*a*.

Figure 6A:
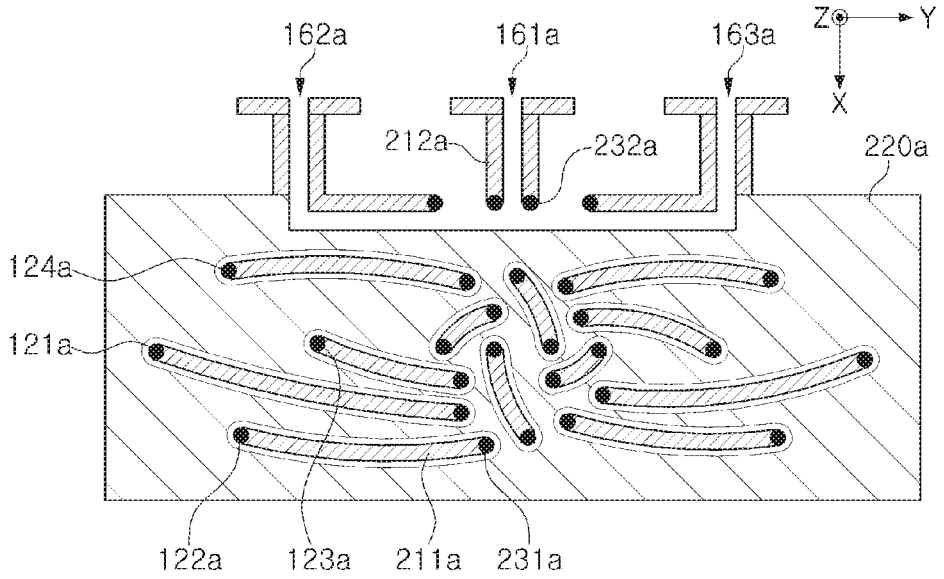
FIG. 6A is a diagram illustrating an example of a feed line of an antenna apparatus.

FIG. 6A is a diagram illustrating an example of a feed line of an antenna apparatus.

Referring to FIG. 6A, a wiring layer 220*a* may include a plurality of first feed lines 211*a* and a plurality of second feed lines 212*a*. The plurality of first feed lines 211*a* may electrically connect a plurality of first, second, third, and fourth feed vias 121*a*, 122*a*, 123*a*, and 124*a* to a plurality of first wiring vias 231*a*. The plurality of second feed lines 212*a* may electrically connect a plurality of end-fire antennas 161*a*, 162*a*, and 163*a* to a plurality of second wiring vias 232*a*. The plurality of first feed lines 211*a* and the plurality of second feed lines 212*a* may be on the same level, but are not limited thereto.

The end-fire antennas 162*a* and 163*a*, which are electrically connected to only one of the plurality of second feed lines 212*a*, may be electrically connected to the wiring layer 220*a*. The wiring layer 220*a* may be electrically connected to the ground layer and/or the second ground layer.

Figure 6B:
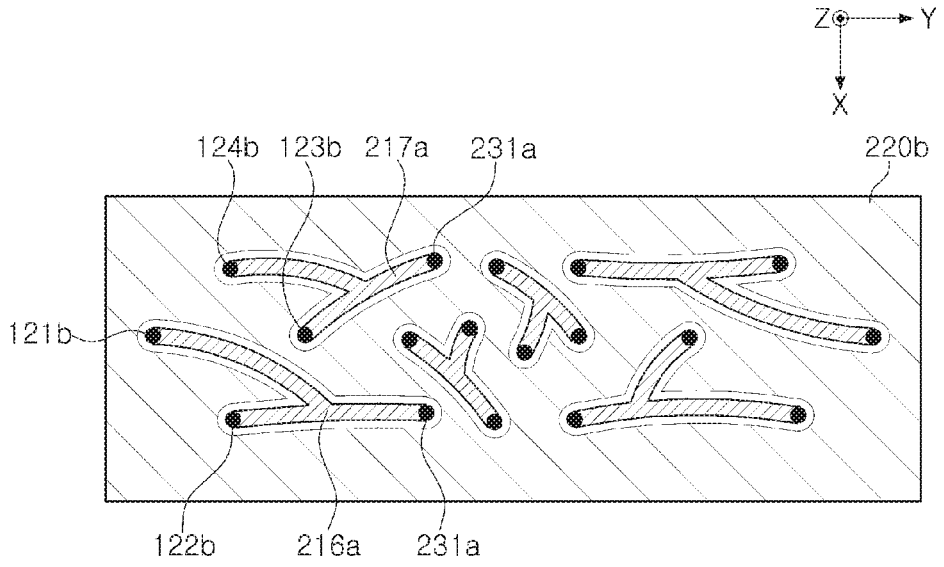
FIG. 6B is a diagram illustrating an example of a branch pattern of an antenna apparatus.

FIG. 6B is a diagram illustrating an example of a branch pattern of an antenna apparatus.

Referring to FIG. 6B, a plurality of first feed lines illustrated in FIG. 6A may be implemented as a plurality of first branch patterns 216*a* and a plurality of second branch patterns 217*a*. For example, a wiring layer 220*b* may include a plurality of first branch patterns 216*a* and a plurality of second branch patterns 217*a*.

The plurality of first branch patterns 216*a* may be electrically connected to the plurality of first wiring vias 231*a* at one end, and may branch RF signals of a first phase to be transferred to a plurality of first and second feed vias 121*b* and 122*b*, respectively. For example, an electrical length from a branch point of each of the plurality of first branch patterns 216*a* to the plurality of first feed vias 121*b* may be equal to an electrical length from a branch point of each of the plurality of first branch patterns 216*a* to the plurality of second feed vias 122*b*. Therefore, a phase of an RF signal passing through the plurality of first feed vias 121*b* and a phase of an RF signal passing through the plurality of second feed vias 122*b* may be the same as each other.

The plurality of second branch patterns 217*a* may be electrically connected to the plurality of first wiring vias 231*a* at one end, and may branch RF signals of a second phase to be transferred to a plurality of third and fourth feed vias 123*b* and 124*b*, respectively. For example, an electrical length from a branch point of each of the plurality of second branch patterns 217*a* to the plurality of third feed vias 123*b* may be equal to an electrical length from a branch point of each of the plurality of second branch patterns 217*a* to the plurality of fourth feed vias 124*b*. Therefore, a phase of an RF signal passing through the plurality of third feed vias 123*b* and a phase of an RF signal passing through the plurality of fourth feed vias 124*b* may be the same as each other.

Further, according to a design, each of the plurality of second branch patterns 217*a* may have an electrical length (for example, 0.5 times the wavelength of the RF signal) different from that of each of the plurality of first branch patterns 216*a*. Therefore, the RF signal of the first phase and the RF signal of the second phase may be implemented without phase conversion of the IC.

Figure 7A:
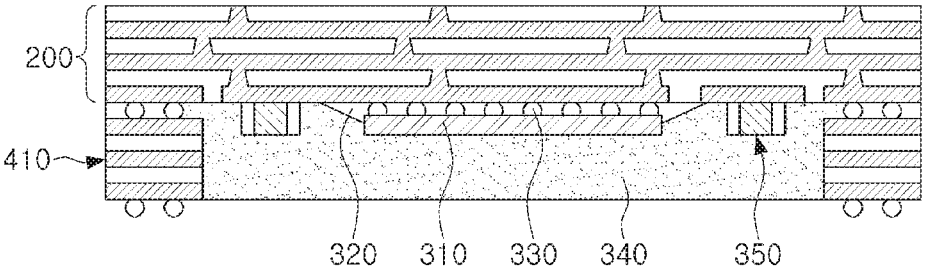
FIGS. 7A and 7B are diagrams illustrating examples of an IC peripheral structure of an antenna apparatus.
Figure 7B:
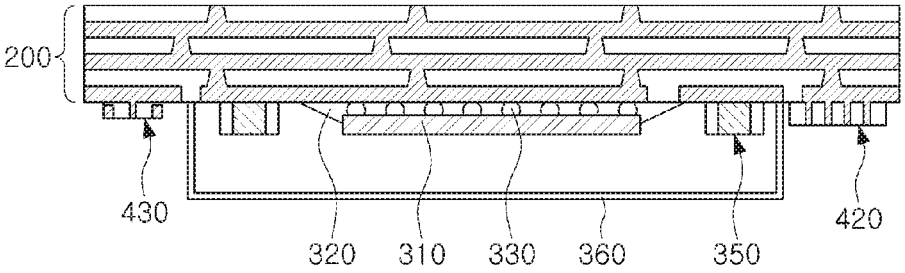

FIGS. 7A and 7B are diagrams illustrating examples of an IC peripheral structure of an antenna apparatus.

Referring to FIG. 7A, an antenna apparatus may include at least a portion of a connection member 200, an IC 310, an adhesive member 320, an electrical connection structure 330, an encapsulant 340, a passive component 350, and a sub-substrate 410.

The connection member 200 may include at least a portion of the ground layer, the wiring ground layer, the second ground layer, and the IC ground layer, described above with reference to FIG. 5.

The IC 310 may be the same as the IC described above, and may be disposed in a position lower than a position of the connection member 200. The IC 310 may be electrically connected to a wiring of the connection member 200 to transmit or receive an RF signal, and may be electrically connected to a ground layer of the connection member 200 to receive a ground. For example, the IC 310 may perform functions such as, for example, frequency conversion, amplification, filtering, phase control, and power generation to generate a converted signal.

The adhesive member 320 may bond the IC 310 and the connection member 200 to each other.

The electrical connection structure 330 may electrically connect the IC 310 and the connection member 200. For example, the electrical connection structure 330 may have a structure such as, for example, a solder ball, a pin, a land, and a pad. The electrical connection structure 330 may have a melting point lower than that of the wiring and the ground layer of the connection member 200, such that the IC 310 and the connection member 200 may be electrically connected through a process using the low melting point.

The encapsulant 340 may be a material such as, for example, photoimageable encapsulant (PIE), Ajinomoto build-up film (ABF), and epoxy molding compound (EMC). The encapsulant 340 may encapsulate at least a portion of the IC 310, and may improve the heat radiation performance and the shock protection performance of the IC 310.

The passive component 350 may be disposed on a lower surface of the connection member 200, and may be electrically connected to the wiring and/or ground layer of the connection member 200 through the electrical connection structure 330. For example, the passive component 350 may include at least a portion of a capacitor (e.g., a multilayer ceramic capacitor (MLCC)), an inductor, or a chip resistor.

The sub-substrate 410 may be disposed in a position lower than a position of the connection member 200, and may be electrically connected to the connection member 200 to receive an intermediate frequency (IF) signal or a baseband signal from the outside and transmit the signal to the IC 310, or receive an IF signal or a baseband signal from the IC 310 and transmit the signal to the outside. In this case, a frequency of the RF signal (for example, 24 GHz, 28 GHz, 36 GHz, 39 GHz, and 60 GHz) may be higher than a frequency of the IF signal (for example, 2 GHz, 5 GHz and 10 GHz).

For example, the sub-substrate 410 may transmit an IF signal or a baseband signal to the IC 310, or may receive the signal from the IC 310 through a wiring that may be included in the IC ground layer of the connection member 200. Since the first ground layer of the connection member 200 is disposed between the IC ground layer and the wiring, the IF signal or the baseband signal and the RF signal may be electrically isolated in the antenna apparatus.

Referring to FIG. 7B, an antenna apparatus may include a portion of a shield member 360, a connector 420, and a chip antenna 430.

The shield member 360 may be disposed in a position lower than a position of a connection member 200, and may be disposed to confine the IC 310 in association with the connection member 200. For example, the shield member 360 may be arranged to cover (e.g., conformal shield) the IC 310 and the passive components 350 together, or cover (e.g., compartment shield) the IC 310 and the passive components 350, respectively. For example, the shield member 360 may have a hexahedral shape with one surface open, and may have a receiving space of a hexahedron through coupling with the connection member 200. The shield member 360 may be formed of a material having high conductivity such as, for example, copper to have a shallow skin depth, and may be electrically connected to the ground layer of the connection member 200. Therefore, the shield member 360 may reduce the electromagnetic noise that the IC 310 and the passive component 350 may receive.

The connector 420 may have a connection structure of a cable (e.g., a coaxial cable, a flexible PCB), may be electrically connected to the IC ground layer of the connection member 200, and may serve as a role similar to the above described sub-substrate. For example, the connector 420 may be provided with an IF signal, a baseband signal, and/or power from the cable, or may provide an IF signal and/or a baseband signal to the cable.

The chip antenna 430 may transmit or receive an RF signal to assist the antenna apparatus. For example, the chip antenna 430 may include a dielectric block having a dielectric constant greater than that of the insulating layer, and a plurality of electrodes disposed on both surfaces of the dielectric block. One of the plurality of electrodes may be electrically connected to the wiring of the connection member 200, and the other may be electrically connected to the ground layer of the connection member 200.

Figure 8A:
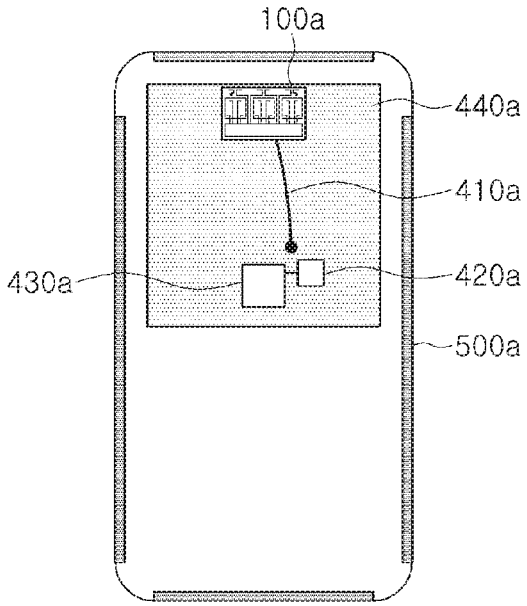
FIGS. 8A and 8B are diagrams illustrating an example of an arrangement of an antenna apparatus in an electronic device.
Figure 8B:
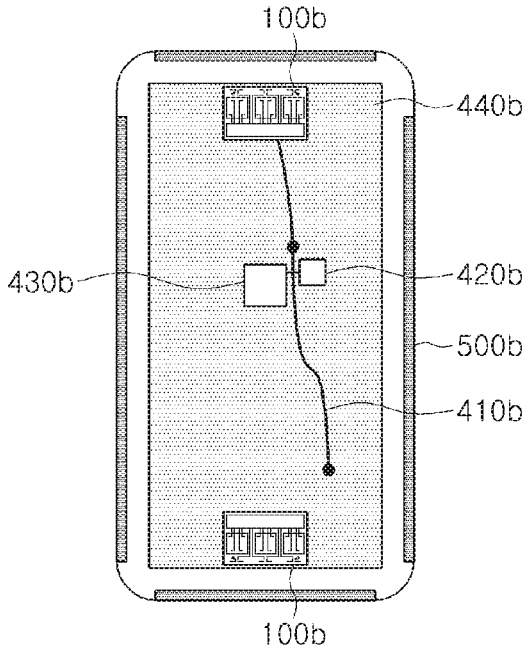

FIGS. 8A and 8B are diagrams illustrating examples of an arrangement of an antenna apparatus in an electronic device.

Referring to FIG. 8A, an antenna apparatus 100*a* is disposed in an electronic device 500*a*. The antenna apparatus 100*a* is disposed on an electronic device substrate 440*a* of the electronic device 500*a*, and is offset from a center of the electronic device 500*a* in a twelve (12) o'clock direction.

The electronic device 500*a* and 500*b* of FIG. 8B may be a smartphone, a smart wearable device, a personal digital assistant, a digital video camera, a digital still camera, a network system, a computer, a monitor, a tablet, a laptop, a netbook, a television, a video game, a smart watch, an internet of things (IoT) device, an automotive, or the like, but is not limited thereto.

A communications module 430*a* and a second IC 420*a* may be further disposed on the electronic device substrate 440*a*. The communications module 430*a* may include at least a portion of a memory chip, such as, for example, a volatile memory (e.g., a DRAM), a non-volatile memory (e.g., a ROM), and a flash memory; an application processor chip, such as, for example, a central processing unit (e.g., a CPU), a graphics processing unit (e.g., a GPU), a digital signal processor, a cryptographic processor, a microprocessor, and a microcontroller; a logic chip, such as, for example, an analog-to-digital converter and an application-specific IC (ASIC) to perform a digital signal process.

The second IC 420*a* may perform an analog-to-digital conversion, amplification in response to an analog signal, filtering, and frequency conversion to generate a base signal. The base signal input/output from the second IC 420*a* may be transferred to the antenna apparatus through the coaxial cable 410*a*.

For example, the base signal may be transferred to the IC through an electrical connection structure, a core via, and a wiring layer. The IC may convert the base signal into an RF signal in a millimeter wave (mmWave) band.

Referring to FIG. 8B, a plurality of antenna apparatuses 100*b* are disposed on an electronic device substrate 440*b* of the electronic device 500*b*. The plurality of antenna apparatuses 100*b* are offset from the center of the electronic device 500*b* in a twelve (12) o'clock direction and a six (6) o'clock direction, respectively. The communication module 430*b* and the second IC 420*b* may be further disposed on the electronic device substrate 440*b*. The communication module 430*b* and/or the second IC 420*b* may be electrically connected to an antenna apparatus through a coaxial cable 410*b*.

In an example, the patch antenna, the feed via, the wiring via, the end-fire antenna, the upper coupling patch, the feed line, and the ground layer may include a metallic material, such as, for example, a conductive material, such as copper (Cu), aluminum (Al), silver (Ag), tin (Sn), gold (Au), nickel (Ni), lead (Pb), titanium (Ti), an alloy thereof, and may be formed according to plating methods such as, for example, a chemical vapor deposition (CVD), a physical vapor deposition (PVD), a sputtering, a subtractive, an additive, a semi-additive process (SAP), and a modified semi-additive process (MSAP).

The insulating layer may be implemented with a thermosetting resin such as, for example, FR4, liquid crystal polymer (LCP), low temperature co-fired ceramic (LTCC), epoxy resin, or a thermoplastic resin such as polyimide, or a resin impregnated into core materials such as glass fiber, glass cloth and glass fabric together with inorganic filler, prepregs, Ajinomoto build-up film (ABF), FR-4, bismaleimide triazine (BT), photoimageable dielectric (PID) resin, a copper clad laminate (CCL), and a glass or ceramic based insulating material. The insulating layer may be filled in at least a portion of positions on which a patch antenna, a feed via, a wiring via, an end-fire antenna, an upper coupling patch, a feed line, and a ground layer are not disposed, in the antenna apparatus.

In the meantime, the RF signals disclosed in the present specification may have a format according to protocols such as, for example, Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols.

While some examples of antenna apparatuses are disclosed, the present disclosure is not limited to the disclosed examples, but, various modifications and changes may be made after an understanding of the disclosure of this application.

The antenna apparatus uses RF signals of two or more phases and four or more feed vias per one patch antenna to minimize electromagnetic interference between a plurality of patch antennas, and to have a high transmission/reception ratio. The plurality of patch antennas may be arranged closer to each other, as the electromagnetic interference between the plurality of patch antennas is smaller. Therefore, the antenna apparatus may have a reduced size while ensuring improved antenna performance.

The antenna apparatus disclosed herein may have improved antenna performance relative to size, since it may have more improved antenna performance (e.g., gain) without increasing the number of feed paths.

The antenna apparatus disclosed herein is capable of improved antenna performance, such as, for example, transmission/reception ratio, gain, and bandwidth, directivity, and having a structure advantageous for miniaturization.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus comprising:

patch antennas arranged in an N×1 array;

first feed vias connected to a point offset, in a first direction, from a center of each of the patch antennas, and through which an RF signal of a first phase passes;

second feed vias connected to a point offset, in a second direction, from a center of each of the patch antennas, and through which the RF signal of the first phase passes;

third feed vias connected to a point offset, in a third direction, from a center of each of the patch antennas, and through which an RF signal of a second phase, different from the first phase, passes;

fourth feed vias connected to a point offset, in a fourth direction, from a center of each of the patch antennas, and through which the RF signal of the second phase passes;

feed lines with an end being electrically connected to the first, second, third, and fourth feed vias, respectively;

second feed lines being electrically connected to an IC; and end-fire antennas electrically connected to one or two of second feed lines, respectively, wherein a line extending between the point in the first direction and the point in the second direction is oblique to a direction of an array of the patch antennas, and a line extending between the point in the third direction and the point in the fourth direction is oblique to the direction of the array of the patch antennas, wherein the end-fire antennas are arranged in parallel with the patch antennas in another N×1 array, and wherein an end-fire antenna electrically connected to two of the second feed lines among the end-fire antennas is more closely centered than an end-fire antenna electrically connected to only one of the second feed lines.

2. The antenna of claim 1, wherein a transmitted RF signal of the patch antennas is transferred from the first to fourth feed vias, and a received RF signal of the patch antennas is transferred to the first to fourth feed vias.

3. The antenna of claim 1, wherein the second phase is different from the first phase by 180 degrees.

4. The antenna of claim 1, wherein each of the patch antennas is quadrangular, and the first, second, third, and fourth directions are directions towards different sides of a quadrangle from the center of the quadrangle.

5. The antenna of claim 4, wherein at least one of the patch antennas comprises:

first slots with the point of the first feed vias being located between the first slots;

second slots with the point of the second feed vias being located between the second slots;

third slots with the point of the third feed vias being located between the third slots; and fourth slots with the point of the fourth feed vias being located between the fourth slots.

6. The antenna of claim 1, further comprising an upper coupling patches spaced apart from the patch antennas and being arranged in another N×1 array.

7. The antenna of claim 1, further comprising:

wiring vias with an end being electrically connected to the IC;

first branch patterns with an end being electrically connected to the wiring vias, respectively, and being configured to branch the RF signal of the first phase to be transferred to the first and second feed vias; and second branch patterns with an end being electrically connected to the wiring vias, respectively, and being configured to branch the RF signals of the second phase to be transferred to the third and fourth feed vias.

8. The antenna of claim 7, wherein each of the second branch patterns has an electrical length different from that of each of the first branch patterns.

9. The antenna of claim 1, further comprising:

wiring vias with an end being electrically connected to the feed lines, respectively; and the IC electrically connected to another end of the wiring vias.

10. The antenna of claim 9, further comprising:

second wiring vias with an end being electrically connected to the IC, wherein second feed lines have an end electrically connected to the second wiring vias, respectively.

11. The antenna of claim 10, further comprising:

ground layers disposed above and below a position of the feed lines, and wherein the feed lines and second feed lines are disposed on a same level.

12. The antenna of claim 10, wherein a number of the feed lines is 4N, a number of the second feed lines is M, wherein M is greater than N, and less than 2N.

13. The antenna of claim 12, wherein N is a multiple of 3, a number of the end-fire antennas is N, M is a multiple of four.

14. The antenna of claim 1, wherein a line extending between the point in the first direction and the point in the third direction is parallel to a direction of an array of the patch antennas, and a line extending between the point in the second direction and the point in the fourth direction is perpendicular to the direction of the array of the patch antennas.

15. The antenna of claim 4, wherein the first, second, third, and fourth vias are positioned substantially adjacent to the edge of the quadrangle.

16. An antenna apparatus comprising:

patch antennas arranged in an N×1 array;

first feed vias connected to a point offset, in a first direction, from a center of each of the patch antennas, and through which an RF signal of a first phase passes;

second feed vias connected to a point offset, in a second direction, from a center of each of the patch antennas, and through which the RF signal of the first phase passes;

third feed vias connected to a point offset, in a third direction, from a center of each of the patch antennas, and through which an RF signal of a second phase, different from the first phase, passes;

fourth feed vias connected to a point offset, in a fourth direction, from a center of each of the patch antennas, and through which the RF signal of the second phase passes;

feed lines with an end being electrically connected to the first, second, third, and fourth feed vias, respectively;

end-fire antennas electrically connected to one or two of second feed lines, respectively; and a ground layer disposed in a position above or below a position of the feed lines, wherein a line extending between the point in the first direction and the point in the second direction is oblique to a direction of an array of the patch antennas, and a line extending between the point in the third direction and the point in the fourth direction is oblique to the direction of the array of the patch antennas, and wherein an end-fire antenna, electrically connected to only one of the second feed lines among the end-fire antennas, is electrically connected to the ground layer.

* * * * *